US010406708B2

(12) United States Patent
Nagayama et al.

(10) Patent No.: US 10,406,708 B2
(45) Date of Patent: Sep. 10, 2019

(54) PAPER SHEET PROCESSING APPARATUS

(71) Applicant: Duplo Seiko Corporation, Kinokawa-ski, Wakayama (JP)

(72) Inventors: Tomoyuki Nagayama, Kinokawa (JP); Tsuyoshi Miyano, Kinokawa (JP); Kazuya Takitani, Kinokawa (JP)

(73) Assignee: Dupo Seiko Corporation, Kinokawa-shi, Wakayama (JP)

( * ) Notice: Subject to any disclaimer, the term of this patent is extended or adjusted under 35 U.S.C. 154(b) by 566 days.

(21) Appl. No.: 15/091,212

(22) Filed: Apr. 5, 2016

(65) Prior Publication Data

US 2016/0303750 A1 Oct. 20, 2016

(30) Foreign Application Priority Data

Apr. 16, 2015 (JP) ..... 2015-084390

(51) Int. Cl.
*B65H 35/00* (2006.01)
*B41J 11/68* (2006.01)
(Continued)

(52) U.S. Cl.
CPC ..... *B26D 5/005* (2013.01); *B65H 5/062* (2013.01); *B65H 7/20* (2013.01); *B65H 35/0086* (2013.01);
(Continued)

(58) Field of Classification Search
CPC ..... B41J 11/68; B41J 11/001; B41J 11/003; B41J 11/006; B41J 11/66; B41J 11/663;
(Continued)

(56) References Cited

U.S. PATENT DOCUMENTS 6,408,750 B1 * 6/2002 Goto ..... B26D 1/205 101/226
2003/0095824 A1 * 5/2003 Ho ..... B41J 11/0025 400/621.1
(Continued)

FOREIGN PATENT DOCUMENTS

EP 2 848 564 A1 3/2015
JP 2005-239308 A 9/2005
(Continued)

OTHER PUBLICATIONS

The extended European Search Report dated Sep. 27, 2016 by the European Patent Office in corresponding European Patent Application No. 16162050.5-1705. (6 pages).
(Continued)

*Primary Examiner* — Evan H MacFarlane
(74) *Attorney, Agent, or Firm* — Buchanan Ingersoll & Rooney PC

(57) ABSTRACT

A paper sheet processing apparatus for processing a paper sheet with conveying the paper sheet having been fed, the apparatus main body including: a paper feed section; a conveyance section; and at least one kind of paper sheet processing section, wherein a paper passable region width Wb defined as a dimension of a paper passable region of the conveyance path in width directions is set to be a maximum width dimension that permits conveyance of the paper sheet without a paper jam in the paper sheet processing section in a standby state, and wherein a prevention section for, when a feed paper sheet width Wp defined as a width dimension of a paper sheet to be fed is greater than the paper passable region width Wb, preventing the to-be-fed paper sheet 100 from being conveyed intact to the paper sheet processing section is further provided.

7 Claims, 12 Drawing Sheets

(51) Int. Cl.

| | |
|---|---|
| ***B26D 5/00*** | (2006.01) |
| ***B65H 5/06*** | (2006.01) |
| ***B65H 35/02*** | (2006.01) |
| ***B65H 7/20*** | (2006.01) |

(52) U.S. Cl.
CPC ..... *B65H 35/02* (2013.01); *B41J 11/68* (2013.01); *B65H 2511/12* (2013.01); *B65H 2511/414* (2013.01); *B65H 2511/528* (2013.01)

(58) Field of Classification Search
CPC ..... B41J 13/0072; B41J 29/387; B41J 29/46; B65H 35/008; B65H 35/0086; B65H 35/02; B65H 35/04; B65H 35/06; B65H 35/08; B65H 2301/5155; B65H 2601/255; B65H 43/00; B65H 43/04; B65H 63/00; B65H 63/02; B65H 2301/141; B65H 7/00; B65H 7/06; B65H 7/10; B65H 7/20; B26D 1/24; B26D 1/245; B26D 5/005
USPC ..... 83/508.1, 508.2, 614; 271/256–261, 271/258.02–258.05
See application file for complete search history.

(56) References Cited

U.S. PATENT DOCUMENTS

| | | | | |
|---|---|---|---|---|
| 2006/0145415 | A1 | 7/2006 | Oota et al. | |
| 2008/0258379 | A1 | 10/2008 | Oota et al. | |
| 2008/0302225 | A1* | 12/2008 | Endresen | B26D 1/025 83/486 |
| 2011/0048266 | A1* | 3/2011 | Crystal | B41J 3/4073 101/483 |
| 2012/0049434 | A1 | 3/2012 | Nonaka | |
| 2013/0342874 | A1 | 12/2013 | Muramoto et al. | |
| 2015/0063951 | A1* | 3/2015 | Kurohata | B42C 1/12 412/1 |

FOREIGN PATENT DOCUMENTS

| | | | | |
|---|---|---|---|---|
| JP | 2005-239312 | A | | 9/2005 |
| JP | 2006-000974 | A | | 1/2006 |
| JP | 2007-044837 | A | | 2/2007 |
| JP | 4762394 | B | | 8/2011 |
| JP | 2011-201647 | A | | 10/2011 |
| JP | 2012-076163 | A | | 4/2012 |
| JP | 2012076163 | A | * | 4/2012 |
| JP | 2012-091278 | A | | 5/2012 |
| JP | 2013064925 | | | 4/2013 |
| JP | 2013064925 | A | * | 4/2013 |

OTHER PUBLICATIONS

Notification of Reasons for Refusal issued in corresponding Japanese Patent Office 2015-084390, dated Jul. 31, 2018, with English Translation (9 pages).

* cited by examiner

PAPER SHEET PROCESSING APPARATUS

BACKGROUND OF THE INVENTION

1. Technical Field

The present invention relates to a paper sheet processing apparatus for processing a paper sheet with conveying the paper sheet having been fed.

2. Background Art

A paper sheet processing apparatus is constructed such that, in a state that a paper sheet having been fed from a paper feed section is conveyed along a conveyance path, various paper sheet processing sections process the paper sheet. In general, in such a paper sheet processing apparatus, an edge part processing section is provided in the upstream in the conveyance direction of the paper sheet and then various paper sheet processing sections are provided in the downstream. The edge part processing section is constructed such as to cut the paper sheet along the conveyance direction and thereby cut off one or both edge parts in the width directions from the paper sheet. As the paper sheet processing sections, a transverse processing section, a conveyance-directional processing section, and the like are employed. The transverse processing section is constructed such as to process the paper sheet along the width directions of the paper sheet. The conveyance-directional processing section is constructed such as to process the paper sheet along the conveyance direction at an arbitrary position in the width directions. Here, the width directions of the paper sheet indicate directions perpendicular to the conveyance direction of the paper sheet.

3. Prior Art References

Patent Document 1: JP Patent No. 4762394

Patent Document 2: JP Laid-open Publication No. 2005-239308

Patent Document 3: JP Laid-open Publication No. 2006-974 Patent Document 4: JP Laid-open Publication No. 2007-44837

Patent Document 5: JP Laid-open Publication No. 2005-239312

Patent Document 6: JP Laid-open Publication No. 2011-201647

Patent Document 7: JP Laid-open Publication No. 2012-76163

Patent Document 8: JP Laid-open Publication No. 2012-91278

SUMMARY OF THE INVENTION

Problem(s) to be Solved by the Invention

Meanwhile, in general, in the paper sheet processing section of the paper sheet processing apparatus, a drive mechanism is provided on one side or both sides in the width directions. Further, the paper sheet need be conveyed without interference with the drive mechanism. This is because when the paper sheet interferes with the drive mechanism, a paper jam occurs or, alternatively, the paper sheet processing section is broken. Thus, the conveyance path has a paper passable region in which the paper sheet can be conveyed without a paper jam in the paper sheet processing section. Then, in general, the paper passable region width defined as a dimension of the paper passable region in the width directions is set to be a maximum width dimension that permits conveyance of the paper sheet without a paper jam in the paper sheet processing section in a standby state.

In spite that the paper passable region width is set up as such, in some cases, an operator erroneously sets paper sheets having a width greater than the paper passable region width into the paper feed section. Then, such a paper sheet having a greater width interferes with the drive mechanism at the time of passing through the paper sheet processing section and thereby causes occurrence of a paper jam or breakage of the paper sheet processing section as described above.

An object of the present invention is to provide a paper sheet processing apparatus in which even when a paper sheet having a width greater than the paper passable region width is set in a paper feed section, the paper sheet is prevented from being conveyed intact to the paper sheet processing section so that occurrence of a paper jam or breakage of the paper sheet processing section can be avoided.

Means for Solving the Problem

The present invention includes the following inventions [1] to [11].

[1] A paper sheet processing apparatus for processing a paper sheet with conveying the paper sheet having been fed, the apparatus main body comprising: a paper feed section for feeding the paper sheet; a conveyance section for conveying the fed paper sheet along a conveyance path; and at least one kind of paper sheet processing section for performing predetermined processing on the conveyed paper sheet, wherein a paper passable region width defined as a dimension of a paper passable region of the conveyance path in width directions perpendicular to a conveyance direction is set to be a maximum width dimension that permits conveyance of the paper sheet without a paper jam in the paper sheet processing section in a standby state, and wherein a prevention section for, when a feed paper sheet width defined as a width dimension of a paper sheet to be fed is greater than the paper passable region width, preventing the to-be-fed paper sheet from being conveyed intact to the paper sheet processing section is further provided.

[2] The paper sheet processing apparatus according to [1], further comprising:

an edge part processing section for cutting the fed paper sheet along the conveyance direction and thereby cutting off one or both edge parts in the width directions from the paper sheet; and a cutting position input section through which an operator inputs a cutting position of the edge part processing section, wherein the prevention section includes:

a first width judgment section for judging whether the feed paper sheet width is greater than the paper passable region width;

a position judgment section for judging whether the inputted cutting position of the edge part processing section is located outside the paper passable region in the width directions; and a first prevention warning section for, when a determination result of the first width judgment section indicates that "the feed paper sheet width is greater" and a determination result of the position judgment section indicates that "the position is located outside", preventing operation of the paper feed section or the conveyance section and/or issuing a warning.

[3] The paper sheet processing apparatus according to [1], wherein the prevention section includes:

a first width judgment section for judging whether the feed paper sheet width is greater than the paper passable region width; and a second prevention warning section for, when a determination result of the first width judgment section indicates that "the feed paper sheet width is greater", preventing operation of the paper feed section or the conveyance section and/or issuing warning.

[4] The paper sheet processing apparatus according to [1], further comprising a width input section through which an operator inputs a final paper sheet width indicating a width dimension of the paper sheet to be obtained after final processing, wherein the prevention section includes:

a first width judgment section for judging whether the feed paper sheet width is greater than the paper passable region width;

a second width judgment section for judging whether the final paper sheet width is greater than the paper passable region width; and a third prevention warning section for, when determination result of the first width judgment section indicates that "the feed paper sheet width is greater" and a determination result of the second width judgment section indicates that "the final paper sheet width is greater", preventing operation of the paper feed section or the conveyance section and/or issuing a warning.

[5] The paper sheet processing apparatus according to [1], further comprising:

an edge part processing section for cutting the fed paper sheet along the conveyance direction and thereby cutting off one or both edge parts in the width directions from the paper sheet; and a cutting position input section through which an operator inputs a cutting position of the edge part processing section, wherein the prevention section includes:

a first width judgment section for judging whether the feed paper sheet width is greater than the paper passable region width;

a position judgment section for judging whether the inputted cutting position of the edge part processing section is located outside the paper passable region in the width directions; and a first setting section for, when a determination result of the first width judgment section indicates that "the feed paper sheet width is greater" and a determination result of the position judgment section indicates that "the position is located outside", setting forcedly the cutting position of the edge part processing section to be a position within the paper passable region.

[6] The paper sheet processing apparatus according to [1], further comprising an edge part processing section for cutting the fed paper sheet along the conveyance direction and thereby cutting off one or both edge parts in the width directions from the paper sheet, wherein the prevention section includes:

a first width judgment section for judging whether the feed paper sheet width is greater than the paper passable region width; and a second setting section for, when a determination result of the first width judgment section indicates that "the feed paper sheet width is greater", setting forcedly the cutting position of the edge part processing section to be a position within the paper passable region.

[7] The paper sheet processing apparatus according to [1], further comprising:

an edge part processing section for cutting the fed paper sheet along the conveyance direction and thereby cutting off one or both edge parts in the width directions from the paper sheet; and a width input section through which an operator inputs a final paper sheet width indicating a width dimension of the paper sheet to be obtained after final processing, wherein the prevention section includes:

a first width judgment section for judging whether the feed paper sheet width is greater than the paper passable region width;

a second width judgment section for judging whether the final paper sheet width is greater than the paper passable region width; and a third setting section for, when a determination result of the first width judgment section indicates that "the feed paper sheet width is greater" and a determination result of the second width judgment section indicates that "the final paper sheet width is greater", setting forcedly the cutting position of the edge part processing section to be a position within the paper passable region.

[8] The paper sheet processing apparatus according to [1], further comprising an edge part processing section for cutting the fed paper sheet along the conveyance direction and thereby cutting off one or both edge parts in the width directions from the paper sheet, wherein the prevention section is constructed from the edge part processing section in which a cutting position in a standby state is set to be a position within the paper passable region.

[9] The paper sheet processing apparatus according to [1], further comprising an edge part processing section for cutting the fed paper sheet along the conveyance direction and thereby cutting off one or both edge parts in the width directions from the paper sheet, wherein the edge part processing section includes at least: a cutting device for cutting the paper sheet; and a width-directional moving mechanism for moving the cutting device in the width directions, and wherein the prevention section is constructed from the edge part processing section controlled such that the width-directional moving mechanism can move the cutting device within the paper passable region alone.

[10] The paper sheet processing apparatus according to any one of [1] to [9], further comprising a paper ejection section for ejecting the processed paper sheet through a paper ejection port of the apparatus main body to the outside, wherein the paper passable region width is set to be a maximum width dimension that permits conveyance of the paper sheet without a paper jam in the paper sheet processing section in a standby state and in the paper ejection port.

[11] The paper sheet processing apparatus according to [1], further comprising an additional processing section for performing predetermined additional processing on the paper sheet ejected through the paper ejection port of the apparatus main body, wherein the paper passable region width is set to be a maximum width dimension that permits conveyance of the paper sheet without a paper jam in the paper sheet processing section in a standby state, in the paper ejection port, and in the additional processing section.

Here, prevention modes performed by the prevention section are divided roughly into the following two classes.

(1) A mode that the paper feed section or the conveyance section is caused not to operate.

(2) A mode that the paper feed section or the conveyance section is caused to operate and that the paper sheet having been fed is cut by the edge part processing section into a paper sheet having a width smaller than the paper passable region width and then conveyed to the paper sheet processing section.

Effect of the Invention

According to the present invention, even when a paper sheet having a width greater than the paper passable region width is set in the paper feed section, the paper sheet is prevented from being conveyed intact to the paper sheet processing section. Thus, occurrence of a paper jam or breakage of the paper sheet processing section can be avoided.

DETAILED DESCRIPTION

First Embodiment

Overall Configuration

Figure 1:
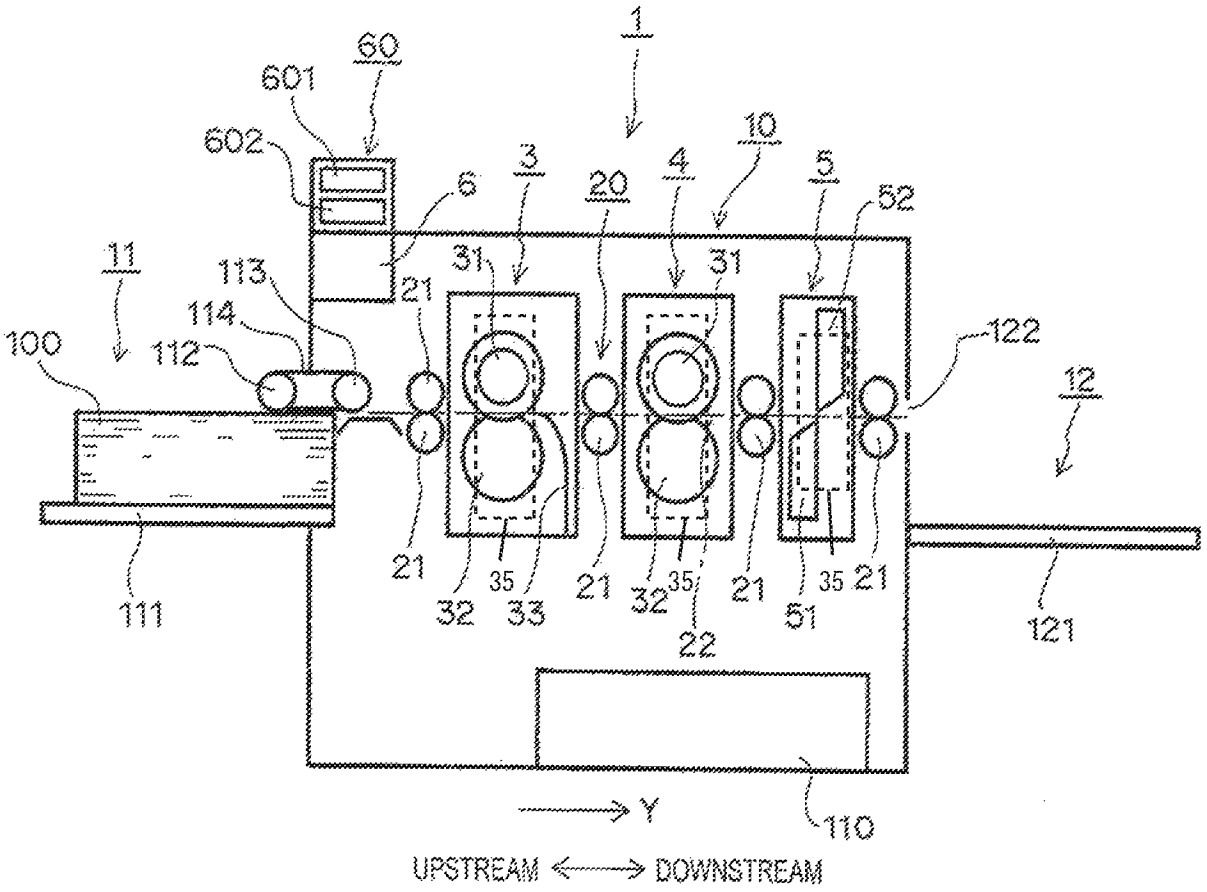
FIG. 1 is a schematic vertical sectional view showing a paper sheet processing apparatus according to a first embodiment of the present invention.

FIG. 1 is a schematic vertical sectional view showing a paper sheet processing apparatus according to a first embodiment of the present invention. The paper sheet processing apparatus 1 includes: a paper feed section 11 provided with a paper feed tray 111; and a paper ejection section 12 provided with a paper ejection tray 121, which are located on both ends of an apparatus main body 10. A conveyance path 22 extending from the paper feed section 11 to the paper ejection section 12 is formed in a conveyance section 20 constructed from a large number of pairs of rollers 21. The conveyance section 20 is constructed such as to convey a paper sheet 100 one by one in the arrow-Y direction from the paper feed section 11 to the paper ejection section 12. In the conveyance direction indicated by the arrow Y, the paper feed section 11 side is referred to as the "upstream" and the paper ejection section 12 side is referred to as the "downstream". Then, along the conveyance path 22, a conveyance correction section, an information reading section, a rejection section, and the like (not shown) as well as an edge part processing section 3 and paper sheet processing sections 4 and 5 are provided in the order from the paper feed section 11 side. In this example, the paper sheet processing section 4 serves as a conveyance-directional processing section for processing the paper sheet along the conveyance direction Y at an arbitrary processing position in the width directions. The paper sheet processing section 5 serves as a transverse processing section for processing the paper sheet along the width directions of the paper sheet. In this example, the processing is cutting. Further, the width directions indicate directions perpendicular to the conveyance direction and indicated by arrows W in FIG. 4. The edge part processing section 3 is constructed such as to cut the paper sheet along the conveyance direction and thereby cut off one or both edge parts in the width directions from the paper sheet.

Further, in the paper sheet processing apparatus 1, a control section 6 for controlling operation of the entire apparatus is provided in the inside of the apparatus main body 10. The control section 6 is constructed from a CPU, a ROM, a RAM, and the like. An operation panel 60 is connected to the control section 6. Further, in the paper sheet processing apparatus 1, a trash box 110 for containing paper shreds (including paper scraps) generated in association with processing on the paper sheet is provided in the bottom part of the inside of the apparatus main body 10.

Figure 5:
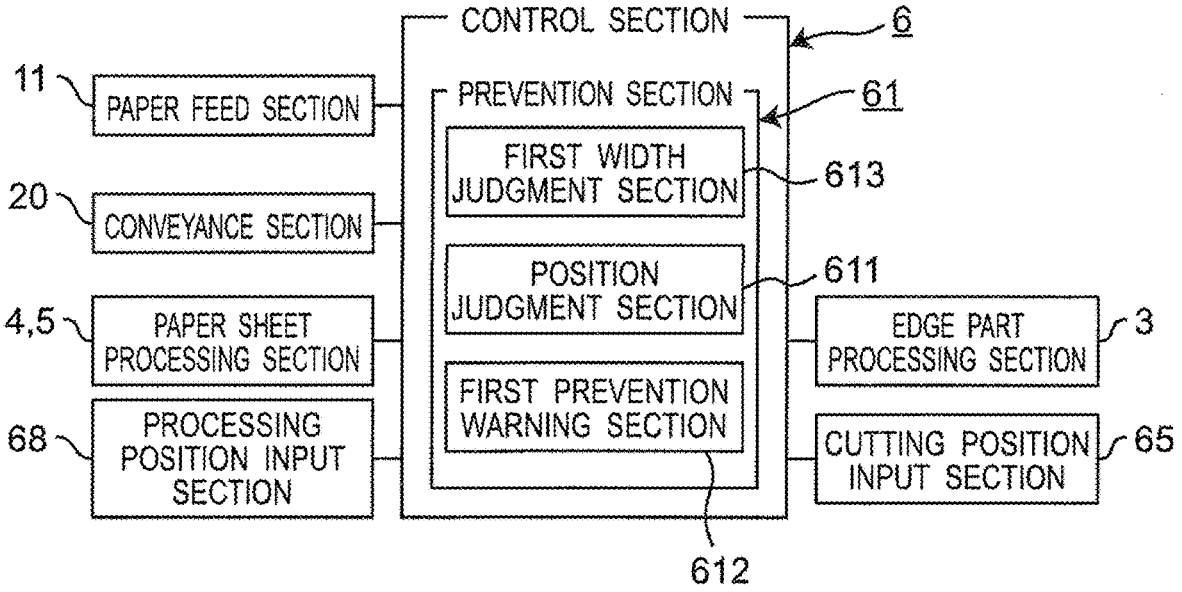
FIG. 5 is a block diagram showing a control section.

The operation panel 60 includes an input section 601 and a display section 602. Through the input section 601, the operator can input processing information for the paper sheet, that is, processing contents including the type and the position of processing on the paper sheet. That is, the input section 601 includes: a "cutting position input section 65" through which a cutting position of the edge part processing section 3 is inputted; and a "processing position input section 68" through which processing positions of the paper sheet processing sections 4 and 5 are inputted individually (FIG. 5). The display section 602 can display the processing information, various messages, and the like.

Further, the operation panel 60 and/or the apparatus main body 10 is provided with a speaker section (not shown) connected to the control section 6.

Further, the upper part of the apparatus main body 10 is provided with an access cover (not shown). By virtue of this, when the access cover is opened in a stopped state of the paper sheet processing apparatus 1, the operator can put the hand into the apparatus main body 10 for the purpose of maintenance or the like of the edge part processing section 3, the paper sheet processing sections 4 and 5, the conveyance section 20, and the like.

Configuration of Each Section

(1) Edge Part Processing Section

Figure 2:
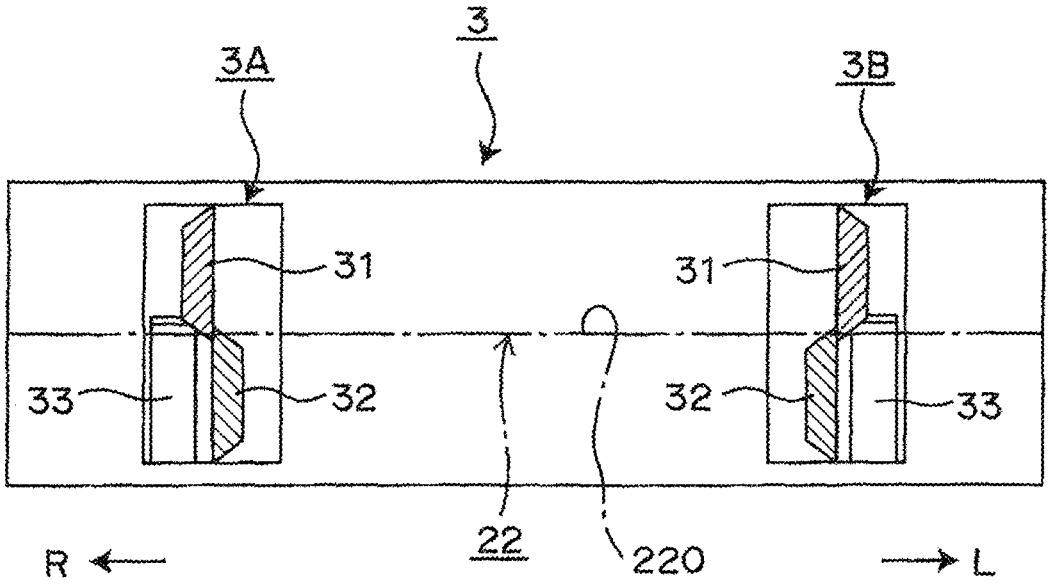
FIG. 2 is a schematic front view showing an edge part processing section viewed from upstream.

FIG. 2 is a schematic front view showing the edge part processing section 3 viewed from upstream. The edge part processing section 3 includes: two cutting devices 3A and 3B;

a rolling mechanism for revolving the two cutting devices 3A and 3B; a width-directional moving mechanism for moving the two cutting devices 3A and 3B individually in the width directions by arbitrary distances. The cutting device 3A is constructed such as to scrub together an upper rotary blade 31 and a lower rotary blade 32 at the position of the conveyance plane 220 of the conveyance path 22 and thereby cut the paper sheet on the conveyance plane 220. Further, the cutting device 3A includes a guide member 33 for guiding the edge part of the paper sheet generated in association with cutting, as paper shreds toward the trash box 110. The cutting device 3B is similar to the cutting device 3A. However, the configurations of the cutting device 3A and the cutting device 3B are mirror symmetric to each other in the width directions. The rolling mechanism includes a revolving shaft (not shown) extending in the width directions and causes the revolving shaft to revolve so that the lower rotary blades 32 of the two cutting devices 3A and 3B revolve. Each upper rotary blade 31 is constructed such as to revolve in association with the revolution of each lower rotary blade 32. The width-directional moving mechanism includes a first threaded shaft and a second threaded shaft (not shown) extending in the width directions. Then, when the first threaded shaft is revolved, the cutting device 3A is moved. Further, when the second threaded shaft is revolved, the cutting device 3B is moved. Here, for example, the edge part processing section 3 may be constructed from a processing section disclosed in JP Laid-open Publication No. 2005-239308 or No. 2006-974, JP Patent No. 4762394, JP Laid-open Publication No. 2012-76163, or the like.

(2) Conveyance-Directional Processing Section

The conveyance-directional processing section serving as the paper sheet processing section 4 includes: two cutting devices 4A and 4B; a rolling mechanism for revolving the two cutting devices 4A and 4B; a width-directional moving mechanism for moving the two cutting devices 4A and 4B individually in the width directions by arbitrary distances. The conveyance-directional processing section has the same configuration as the edge part processing section 3 except for the point that the cutting devices 4A and 4B do not include the guide members 33. Here, for example, the conveyance-directional processing section may be constructed from a processing section disclosed in JP Laid-open Publication No. 2006-974, No. 2012-91278, or the like.

(3) Transverse Processing Section

Figure 3:
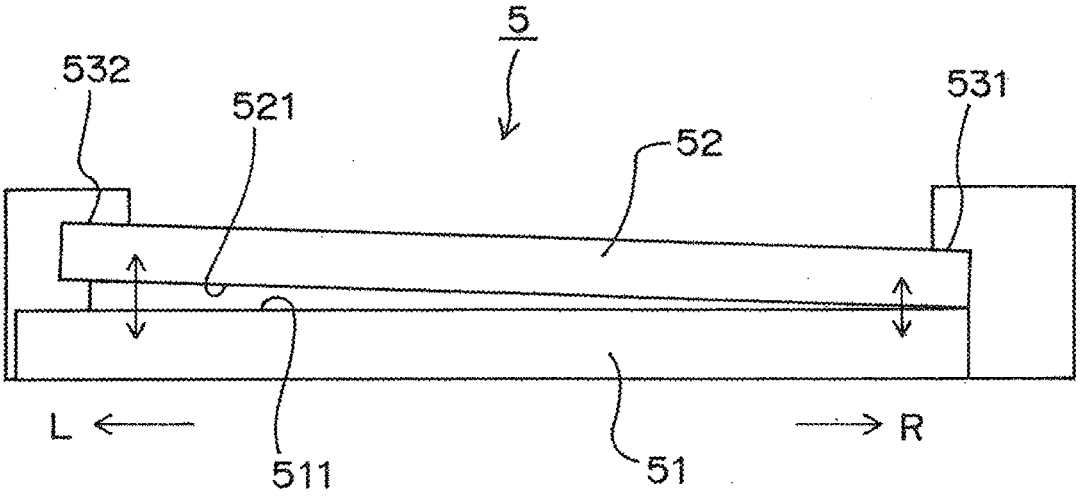
FIG. 3 is a schematic front view showing a transverse processing section serving as a paper sheet processing section, viewed from downstream.

FIG. 3 is a schematic front view showing the transverse processing section serving as the paper sheet processing section 5, viewed from downstream. The paper sheet processing section 5 includes a lower stationary blade 51 and an upper movable blade 52 extending in the width directions. The blade edge 511 of the stationary blade 51 extends horizontally. The blade edge 521 of the movable blade 52 is inclined such that one end 532 is higher than the other end 531. The paper sheet processing section 5 is constructed such as to move the movable blade 52 in the up and down directions so as to scrub together the blade edge 521 and the blade edge 511 at the position of the conveyance plane 220 (FIG. 2) of the conveyance path 22 and thereby cut the paper sheet on the conveyance plane 220. Here, for example, the transverse processing section may be constructed from a processing section disclosed in JP Laid-open Publication No. 2005-239312, No. 2007-44837, No. 2011-201647, or the like.

(4) Paper Feed Section

As shown in FIG. 1, the paper feed section 11 is constructed such that the paper sheets 100 stacked in the paper feed tray 111 are fed one by one from the top to the conveyance path 22 by a paper feed belt 114 wound around a roller 112 and a roller 113.

(5) Conveyance Section

Figure 4:
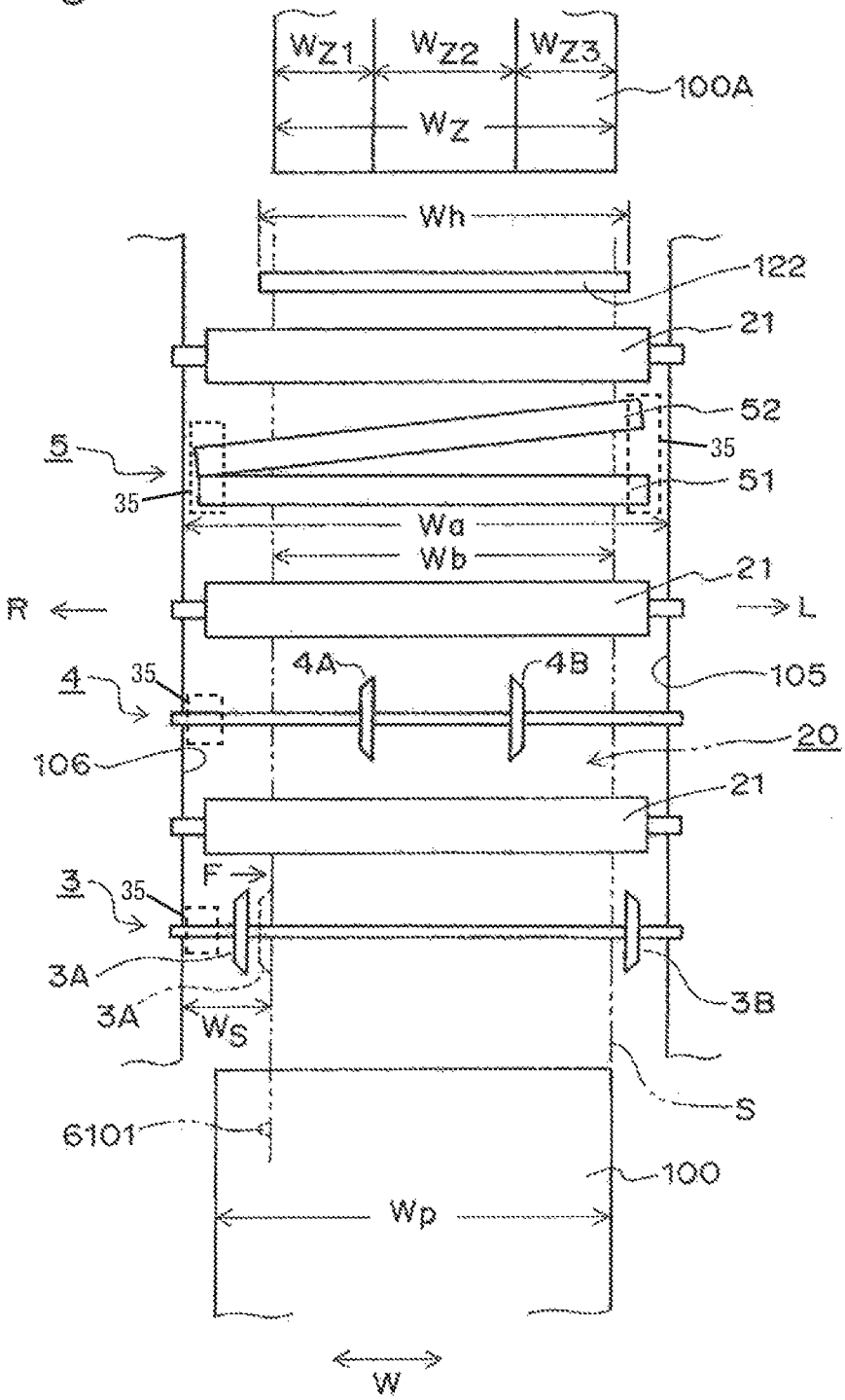
FIG. 4 is a schematic plan view showing the inside of an apparatus main body.

FIG. 4 is a schematic plan view showing the inside of the apparatus main body 10. The conveyance section 20 is constructed from a large number of pairs of rollers 21. Functionally, the conveyance section 20 can convey the paper sheet within the range of a width Wa. The width Wa indicates the range between both frames 105 and 106 opposite to each other in the width directions of the apparatus main body 10. Nevertheless, in practice, in the conveyance section 20, a drive mechanism (not shown) 35 is arranged on the one side or both sides in the width directions of the paper sheet processing sections 4 and 5 and the like and hence serves as an obstacle against conveyance of the paper sheet. Thus, the paper sheet is allowed to be conveyed within the range of a width Wb smaller than the width Wa. The range of the width Wb is referred to as a "paper passable region" and the dimension of the width Wb is referred to as a "paper passable region width". That is, the paper passable region width is set to be the maximum width dimension that permits conveyance of the paper sheet without a paper jam in the paper sheet processing sections 4 and 5 in a standby state. In general, this dimension is the maximum width dimension that permits conveyance of the paper sheet without a paper jam in the transverse processing section at the time that the transverse processing section serving as the paper sheet processing section 5 is in a standby state. Here, in the present embodiment, the conveyance section 20 is constructed such as to convey the paper sheet in a one-side reference mode, that is, with adopting a reference S on the L-side in FIG. 4.

(6) Paper Ejection Section

The paper ejection section 12 is constructed such as to receive the paper sheet having been processed and then ejected along the conveyance path 22 through the paper ejection port 122, with stacking each in the paper ejection tray 121.

(7) Control Section

The control section 6 is constructed such as to control operation of the entire apparatus. FIG. 5 is a block diagram showing the control section 6. In particular, the control section 6 includes a prevention section 61 for, the feed paper sheet width Wp defined as the width dimension of the paper sheet 100 having been set in the paper feed section 11, that is, of the paper sheet 100 to be fed, is greater than the paper passable region width Wb as shown in FIG. 4, preventing the paper sheet 100 from being conveyed intact to the paper sheet processing sections 4 and 5.

Then, the prevention section 61 includes a first width judgment section 613, a position judgment section 611, and a first prevention warning section 612. The first width judgment section 613 is constructed such as to judge whether the feed paper sheet width Wp is greater than the paper passable region width Wb. For example, the first width judgment section 613 is constructed such as to perform the judgment by comparing the paper passable region width Wb with the feed paper sheet width Wp inputted through the input section 601 of the operation panel 60. Alternatively, for example, the first width judgment section 613 is constructed such as to perform the judgment depending on whether a sensor 6101 arranged on the immediate outer side of the outer edge of the paper passable region as shown in FIG. 4 detects the extension of the paper sheet 100. The position judgment section 611 is constructed such as to judge whether the cutting position of the edge part processing section 3 inputted through the cutting position input section 65 is located outside the paper passable region in the width directions. The first prevention warning section 612 is constructed such that when the determination result of the first width judgment section 613 indicates that "the feed paper sheet width Wp is greater" and the determination result of the position judgment section 611 indicates that "the position is located outside", the first prevention warning section 612 prevents operation of the paper feed section 11 or the conveyance section 20 and then issues a warning. For example, the "prevention" is achieved by disabling depression of a start button (not shown) for the entire apparatus or, alternatively, by shutting off energization to the drive section of the paper feed section 11 or the conveyance section 20 even when the start button is pressed. Further, for example, the "warning" is achieved by generating sound or voice through the speaker section, by displaying on the display section 602 a text or the like notifying the warning, or by performing both.

Operation

As shown in FIG. 4, at the time that the operator sets the paper sheets 100 having a width Wp greater than the paper passable region width Wb into the paper feed section 11, then inputs the cutting position of the edge part processing section 3 through the cutting position input section 65 of the operation panel 60, then inputs the processing positions of the paper sheet processing sections 4 and 5 through the processing position input section 68, and then presses the start button (not shown) for the entire apparatus, the paper sheet processing apparatus 1 operates as follows. Here, in this example, the cutting position of the edge part processing section 3 and the processing position of the paper sheet processing section 4 are inputted as distances from the reference S in the width directions. Here, in the present embodiment, the reference S is premised to agree with the edge on the L-side of the paper passable region. Further, in this example, it is premised that the inputted cutting position of the edge part processing section 3 is such that the cutting device 3A of the R-side departs outside (on the R-side) in the width directions relative to the paper passable region and the cutting device 3B on the L-side is located at a standby position. Here, in the present embodiment, the paper sheet is conveyed with adopting the reference S on the L-side and hence cutting of the edge part on the L-side of the paper sheet 100 is unnecessary. Thus, the standby position of the cutting device 3B on the L-side is set to be a position departing outside (on the L-side) in the width directions relative to the reference S.

That is, when the start button is pressed, the prevention section 61 starts operating. That is, first, the first width judgment section 613 operates so as to judge whether the feed paper sheet width Wp is greater than the paper passable region width Wb. In this example, the first width judgment section 613 judges that "the feed paper sheet width Wp is greater". Further, the position judgment section 611 operates so as to judge whether the inputted cutting position is located outside the paper passable region in the width directions. In this example, the position judgment section 611 judges that "the position is located outside". Then, in association with the determination results of the first width judgment section 613 and the position judgment section 611, the first prevention warning section 612 operates so as to prevent operation of the paper feed section 11 or the conveyance section 20 and then issue a warning.

Effects

In a case that the paper sheet 100 having a width Wp greater than the paper passable region width Wb is set in the paper feed section 11, when the cutting position of the cutting device 3A of the edge part processing section 3 is located outside the paper passable region in the width directions, even when the cutting device 3A operates, the paper sheet having a width greater than the paper passable region width Wb is fed to the conveyance section 20 and then conveyed to the paper sheet processing sections 4 and 5. This causes a paper jam in the paper sheet processing sections 4 and 5.

However, according to the present embodiment, in a case that the paper sheet 100 having a width Wp greater than the paper passable region width Wb is set in the paper feed section 11, when the cutting position of the cutting device 3A of the edge part processing section 3 is located outside the paper passable region in the width directions, the first prevention warning section 612 operates so as to prevent operation of the paper feed section 11 or the conveyance section 20. Thus, the paper sheet can be prevented from being conveyed to the paper sheet processing sections 4 and 5. This "prevention" avoids occurrence of a paper jam in the paper sheet processing sections 4 and 5. Further, the first prevention warning section 612 issues a warning also. Thus, the operator can recognize that the paper sheet 100 in the paper feed section 11 is inappropriate or that the inputted cutting position is inappropriate. Accordingly, the operator can immediately remove the paper sheet 100 from the paper feed section 11 or re-input an appropriate cutting position.

Thus, this "warning" also can avoid occurrence of a paper jam in the paper sheet processing sections 4 and 5.

Modifications

In the present embodiment, the following configurations may be employed.

(1) The paper passable region width is set to be the maximum width dimension that permits conveyance of the paper sheet without a paper jam not only in the paper sheet processing sections 4 and 5 in a standby state but also in the paper ejection port 122. By virtue of this, in a case that the paper sheet having a width greater than the paper passable region width is set in the paper feed section 11, a paper jam can be avoided not only in the paper sheet processing sections 4 and 5 but also in the paper ejection port 122. Here, the paper ejection port 122 is formed in a width as narrow as possible. This is because when the paper ejection port 122 is excessively wide, a high possibility arises that the operator puts the hand through the paper ejection port 122 into the apparatus main body 10 and then touches a movable member so as to get hurt. In the present embodiment, as shown in FIG. 4, the width Wh of the paper ejection port 122 is greater than the width Wb and hence the "paper passable region width" is set equal to the width Wb. In contrast, when width Wh≤width Wb, the "paper passable region width" is set equal to the width Wh.

(2) The first prevention warning section 612 executes any one of "prevention" and "warning".

(3) The edge part processing section 3 and the paper sheet processing sections 4 and 5 are supported in an attachable and detachable manner by the apparatus main body 10. For example, a detailed configuration of this is disclosed in JP Laid-open Publication No. 2005-239308, No. 2005-239312, No. 2012-76163, or the like.

(4) Paper sheet processing sections of other types are employed as the paper sheet processing sections 4 and 5. Here, the number and the types of paper sheet processing sections are determined in accordance with the number and the types of processing.

Second Embodiment

Figure 6:
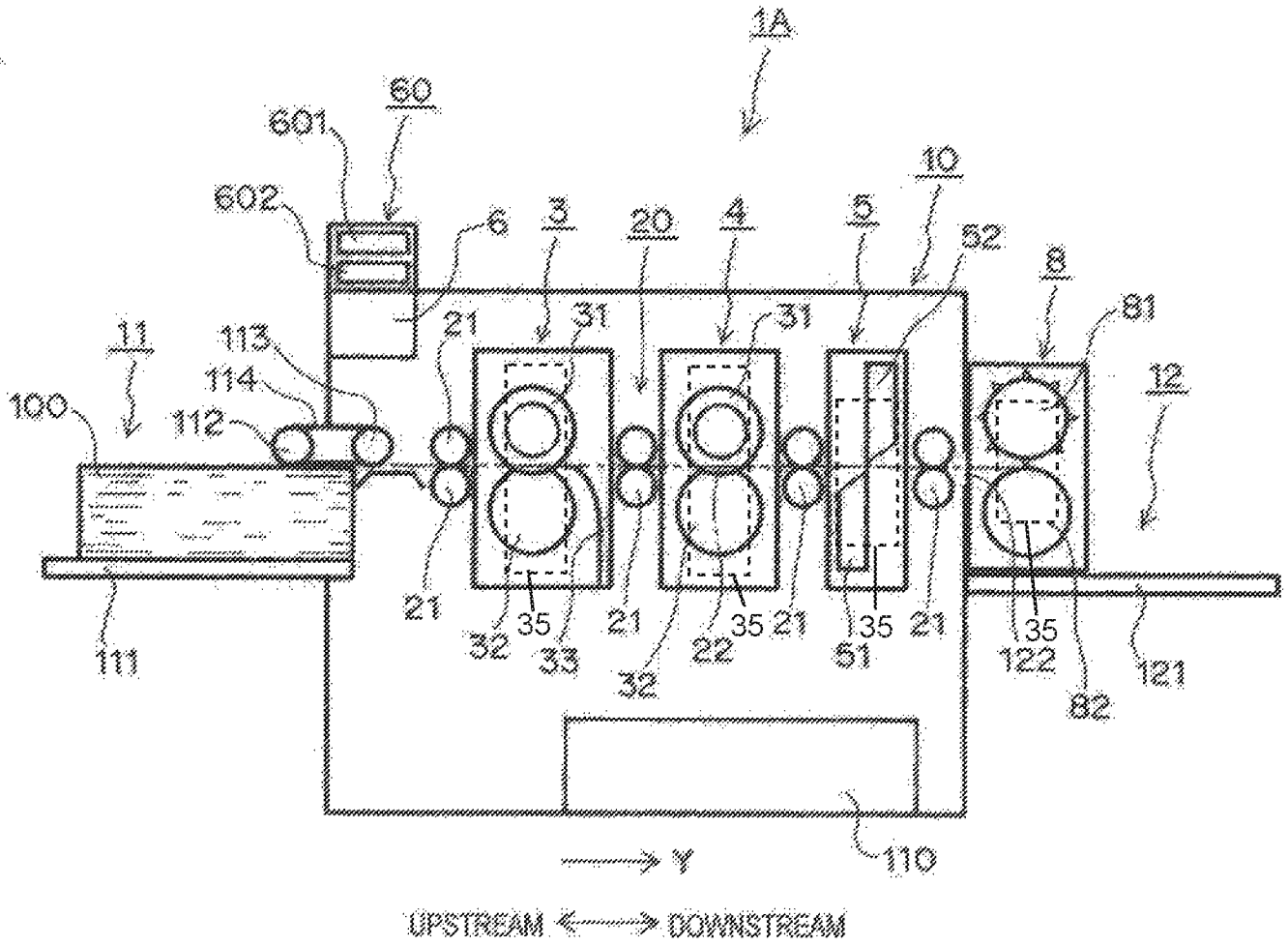
FIG. 6 is a schematic vertical sectional view showing a paper sheet processing apparatus according to a second embodiment of the present invention.

FIG. 6 is a schematic vertical sectional view showing a paper sheet processing apparatus 1A according to a second embodiment of the present invention. The present embodiment is different from the first embodiment in the following point alone. That is, in the present embodiment, an additional processing section 8 is provided in the outside of the apparatus main body 10 in a manner of being connected directly to the paper ejection port 122. The additional processing section 8 performs additional processing on the paper sheet in addition to the processing of the edge part processing section 3 and the paper sheet processing sections 4 and 5. In the present embodiment, a perforation processing section for forming a perforation in the paper sheet along the conveyance direction Y at an arbitrary processing position in the width directions is employed as the additional processing section 8. Then, in the present embodiment, the "paper passable region width" is set to be the maximum width dimension that permits conveyance of the paper sheet without a paper jam not only in the paper sheet processing sections 4 and 5 and the paper ejection port 122 in a standby state but also in the additional processing section 8.

Figure 7:
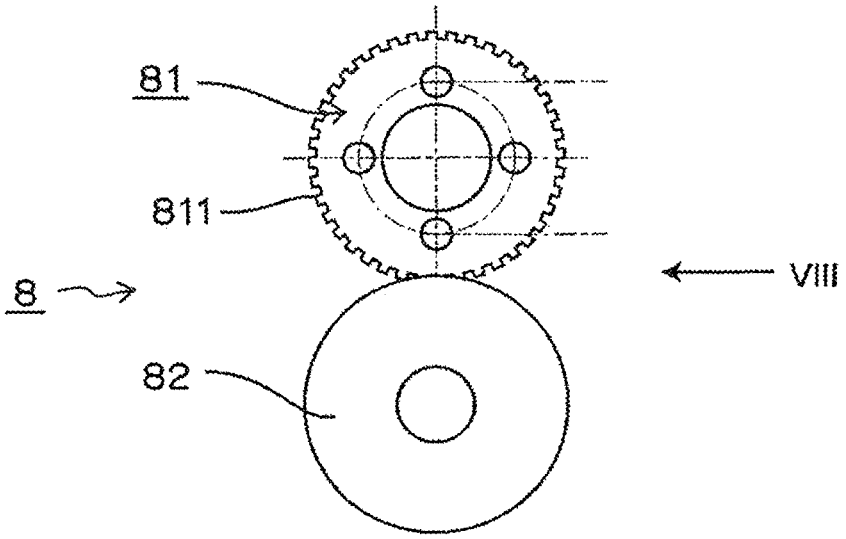
FIG. 7 is a diagram showing a blade of a perforation processing section.
Figure 8:
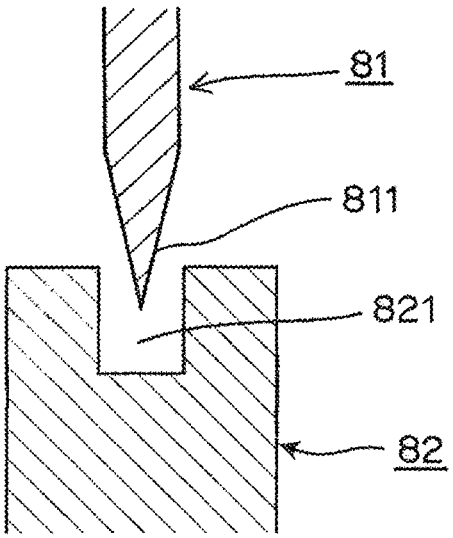
FIG. 8 is an expanded sectional view taken from an arrow-VIII direction in FIG. 7.

The perforation processing section serving as the additional processing section 8 has a configuration that, as shown in FIG. 7 and in FIG. 8 showing a view taken from an arrow-VIII direction in FIG. 7, a gear wheel blade 81 and a fixed blade 82 are employed in place of the upper rotary blade 31 and the lower rotary blade 32 of the paper sheet processing section 4. Specifically, the perforation processing section is constructed such that an acute angle tip part 811 of the gear wheel blade 81 together with the paper sheet is inserted into a recess 821 of the fixed blade 82 so that a perforation is formed in the paper sheet. The other points are similar to those of the paper sheet processing section 4.

According to the present embodiment, in a case that the paper sheet 100 having a width Wp greater than the paper passable region width Wb is set in the paper feed section 11, when the cutting position of the cutting device 3A of the edge part processing section 3 is located outside the paper passable region in the width directions, similarly to the first embodiment, the first prevention warning section 612 operates so as to prevent operation of the paper feed section 11 or the conveyance section 20. Thus, The paper sheet can be prevented from being conveyed to the paper sheet processing sections 4 and 5, the paper ejection port 122, and the additional processing section 8. This "prevention" avoids a situation that a paper jam occurs in the paper sheet processing sections 4 and 5, the paper ejection port 122, or the additional processing section 8. Further, the first prevention warning section 612 issues a warning also. Thus, the operator can recognize that the paper sheet 100 in the paper feed section 11 is inappropriate or that the inputted cutting position is inappropriate. Accordingly, the operator can immediately remove the paper sheet 100 from the paper feed section 11 or re-input an appropriate cutting position. This "warning" also avoids a situation that a paper jam occurs in the paper sheet processing sections 4 and 5, the paper ejection port 122, or the additional processing section 8.

Modifications

Configurations (2) to (4) in the modifications to the first embodiment may be employed.

Third Embodiment

Figure 9:
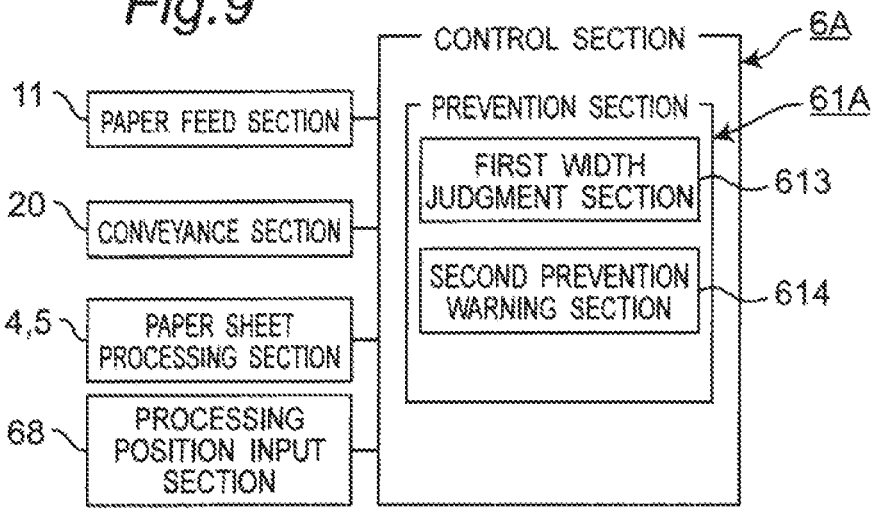
FIG. 9 is a block diagram showing a control section of a paper sheet processing apparatus according to a third embodiment of the present invention.

FIG. 9 is a block diagram showing a control section 6A of a paper sheet processing apparatus according to a third embodiment of the present invention. The present embodiment is different from the first embodiment in the following points alone.

(a) The cutting position input section 65 and the edge part processing section 3 are not provided.

(b) The prevention section 61A includes a first width judgment section 613 and a second prevention warning section 614. The first width judgment section 613 is the same as that in the first embodiment. The second prevention warning section 614 is constructed such as to, when the determination result of the first width judgment section 613 indicates that "the feed paper sheet width Wp is greater", prevent operation of the paper feed section 11 or the conveyance section 20 and then issue a warning.

Detailed examples of "prevention" and "warning" of the second prevention warning section 614 are the same as those in the first embodiment.

According to the present embodiment, when the determination result of the first width judgment section 613 indicates that "the feed paper sheet width Wp is greater", the second prevention warning section 614 operates so as to prevent operation of the paper feed section 11 or the conveyance section 20. Thus, the paper sheet can be prevented from being conveyed to the paper sheet processing sections 4 and 5. This "prevention" avoids occurrence of a paper jam in the paper sheet processing sections 4 and 5. Further, the second prevention warning section 614 issues also a warning. Thus, the operator can recognize that the paper sheet in the paper feed section is inappropriate. Accordingly, the operator can immediately remove the paper sheet 100 from the paper feed section 11. Thus, this "warning" also can avoid occurrence of a paper jam in the paper sheet processing sections 4 and 5.

Here, the second prevention warning section 614 may execute any one of "prevention" and "warning".

The other operation effects are the same as those in the first embodiment.

Modifications (1) The cutting position input section 65 and the edge part processing section 3 may be provided. In this case, regardless of the cutting position of the edge part processing section 3, on the basis of the determination result of the first width judgment section 613, the prevention section 61A causes the second prevention warning section 614 to operate.

(2) Configurations (1), (3), and (4) in the modifications to the first embodiment may be employed.

Fourth Embodiment

Figure 10:
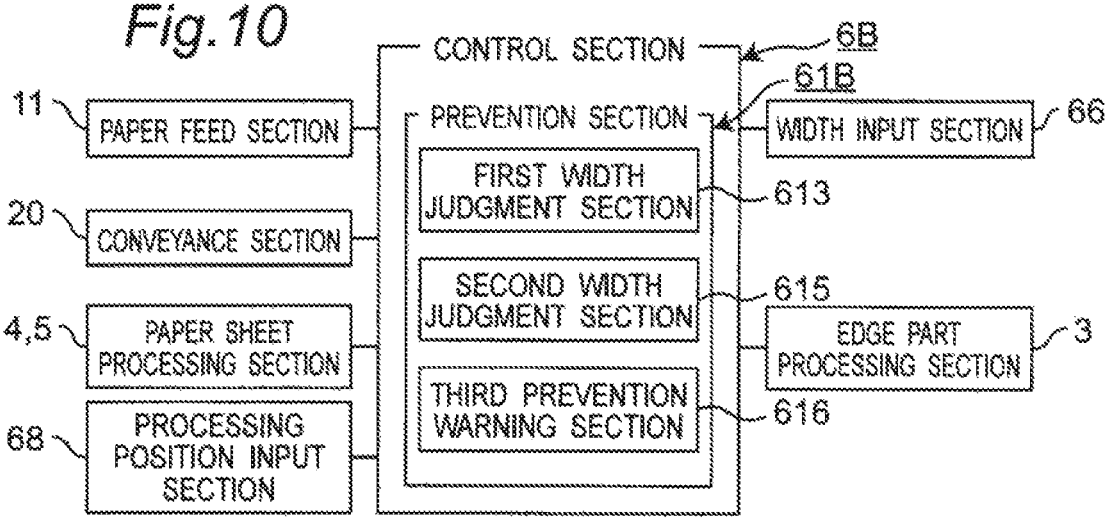
FIG. 10 is a block diagram showing a control section of a paper sheet processing apparatus according to a fourth embodiment of the present invention.

FIG. 10 is a block diagram showing a control section 6B of a paper sheet processing apparatus according to a fourth embodiment of the present invention. The present embodiment is different from the first embodiment in the following points alone.

(a) The cutting position input section 65 is not provided.

(b) A width input section 66 is provided. The width input section 66 is constructed such that through the width input section 66, the operator inputs a final paper sheet width Wz (FIG. 4) indicating a width dimension of the paper sheet 100A to be obtained after final processing. The width input section 66 is included in the input section 601 of the operation panel 60.

(c) The prevention section 61B includes a first width judgment section 613, a second width judgment section 615, and a third prevention warning section 616. The first width judgment section 613 is the same as that in the first embodiment. The second width judgment section 615 is constructed such as to judge whether the final paper sheet width Wz is greater than the paper passable region width Wb. The third prevention warning section 616 is constructed such that when the determination result of the first width judgment section 613 indicates that "the feed paper sheet width Wp is greater" and the determination result of the second width judgment section 615 indicates that "the final paper sheet width Wz is greater", the third prevention warning section 616 prevents operation of the paper feed section 11 or the conveyance section 20 and then issues a warning.

For example, the second width judgment section 615 is constructed such as to perform the judgment by comparing the paper passable region width Wb with the final paper sheet width Wz inputted through the input section 601 of the operation panel 60. Here, in a case that the paper sheet having been processed is in the form of being divided into a plurality, the final paper sheet width is equal to the total of the widths of the divided paper sheets. For example, in a case that the paper sheet 100A having been processed is in the form of being divided into three as shown in FIG. 4, the final paper sheet width Wz is equal to the total of the widths Wz1, Wz2, and Wz3 of the individual divided paper sheets.

Detailed examples of "prevention" and "warning" of the third prevention warning section 616 are the same as those in the first embodiment.

According to the present embodiment, when the determination result of the first width judgment section 613 indicates that "the feed paper sheet width Wp is greater" and the determination result of the second width judgment section 615 indicates that "the final paper sheet width Wz is greater", the third prevention warning section 616 operates so as to prevent operation of the paper feed section 11 or the conveyance section 20. Thus, the paper sheet can be prevented from being conveyed to the paper sheet processing sections 4 and 5. This "prevention" avoids occurrence of a paper jam in the paper sheet processing sections 4 and 5. Further, the third prevention warning section 616 issues a warning also. Thus, the operator can recognize that the paper sheet 100 in the paper feed section 11 is inappropriate or that the inputted final paper sheet width is inappropriate. Accordingly, the operator can immediately remove the paper sheet 100 from the paper feed section 11 or re-input an appropriate final paper sheet width. Thus, this "warning" also can avoid occurrence of a paper jam in the paper sheet processing sections 4 and 5.

The other operation effects are the same as those in the first embodiment.

Modifications (1) The third prevention warning section 616 may execute any one of "prevention" and "warning".

(2) Configurations (1), (3), and (4) in the modifications to the first embodiment may be employed.

Fifth Embodiment

Figure 11:
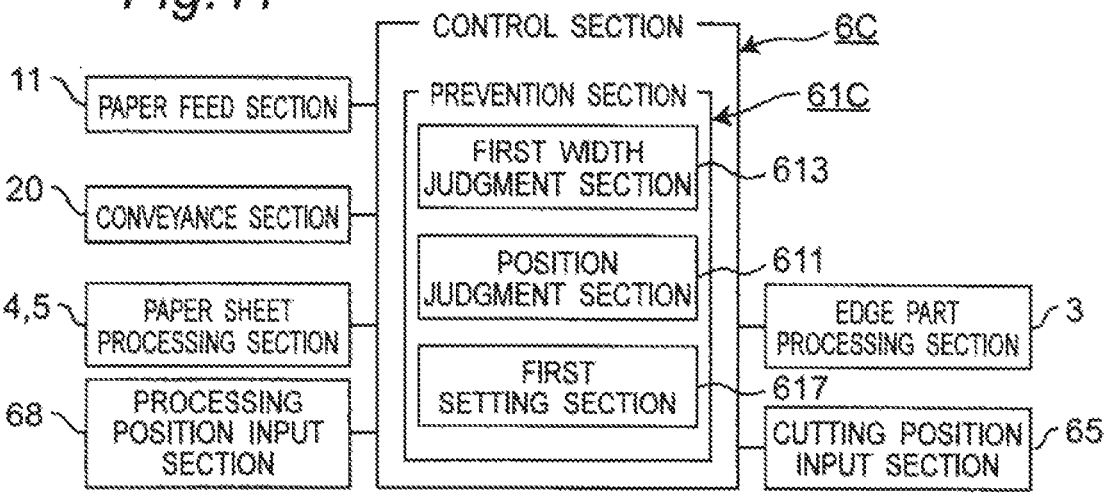
FIG. 11 is a block diagram showing a control section of a paper sheet processing apparatus according to a fifth embodiment of the present invention.

FIG. 11 is a block diagram showing a control section 6C of a paper sheet processing apparatus according to a fifth embodiment of the present invention. The present embodiment is different from the first embodiment in the following point alone.

(a) The prevention section 61C includes a first width judgment section 613, a position judgment section 611, and a first setting section 617. The first width judgment section 613 and the position judgment section 611 are the same as those in the first embodiment.

The first setting section 617 is constructed such that when the determination result of the first width judgment section 613 indicates that "the feed paper sheet width Wp is greater" and the determination result of the position judgment section 611 indicates that "the position is located outside", the first setting section 617 sets forcedly the cutting position of the edge part processing section 3 to be a position within the paper passable region. In this example, the cutting position of the cutting device 3A is forcedly set to be a position within the paper passable region. For example, when the cutting position of the cutting device 3A is inputted such as to fall within a range Ws as shown in FIG. 4, the first setting section 617 causes the width-directional moving mechanism of the cutting device 3A of the edge part processing section 3 to operate so as to move the cutting device 3A in the width direction as indicated by an arrow F such that the processing position may fall within the paper passable region. Here, the expression "within the paper passable region" indicates being within the range of the paper passable region width Wb and indicates that the outer edge of the paper passable region is also included.

Figure 12:
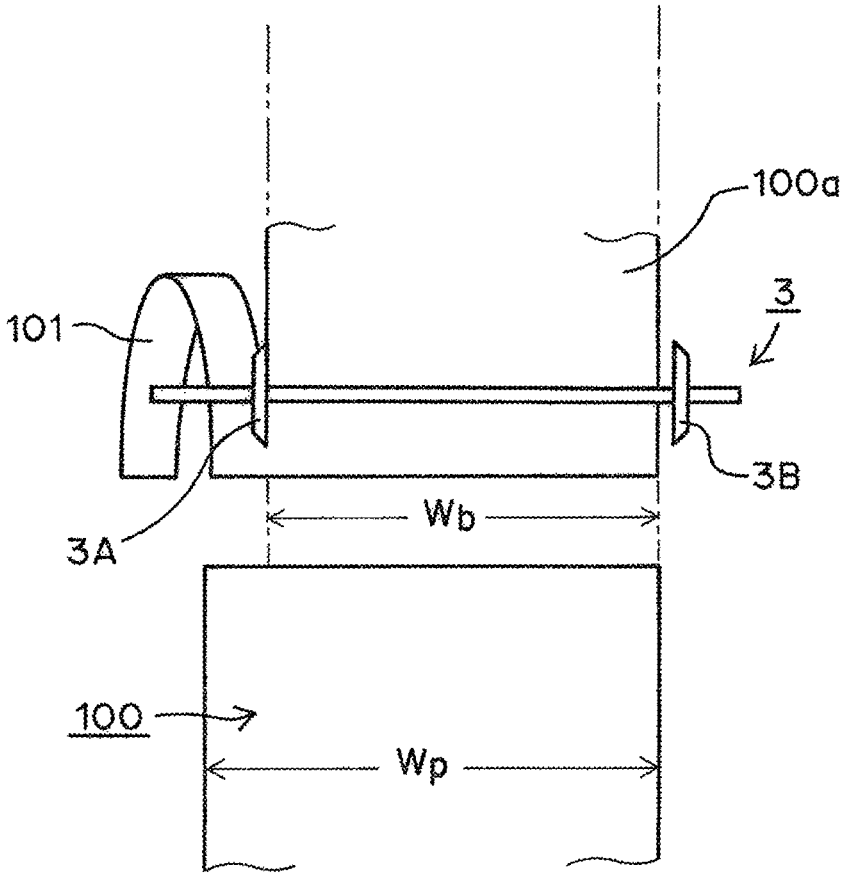
FIG. 12 is a schematic part plan view showing an operating state in a fifth embodiment.

According to the present embodiment, when the determination result of the first width judgment section 613 indicates that "the feed paper sheet width Wp is greater" and the determination result of the position judgment section 611 indicates that "the position is located outside", the first setting section 617 operates so as to set forcedly the cutting position of the cutting device 3A to be a position within the paper passable region. Thus, in a case that a paper sheet having a width greater than the paper passable region width Wb is set in the paper feed section 11, as shown in FIG. 12, the paper sheet 100 is cut by the cutting device 3A and hence the edge part 101 is separated from the paper sheet 100 so that a paper sheet 100*a* having a width smaller than or equal to the paper passable region width Wb is reliably obtained. Even when the paper sheet 100*a* is conveyed to the paper sheet processing sections 4 and 5, the paper sheet 100*a* does not interfere with the drive mechanism for the paper sheet processing sections 4 and 5 and hence a paper jam does not occur there. Thus, a paper jam is avoided in the paper sheet processing sections 4 and 5 and the paper ejection port 122.

Modifications

Configurations (1), (3), and (4) in the modifications to the first embodiment may be employed.

Sixth Embodiment

Figure 13:
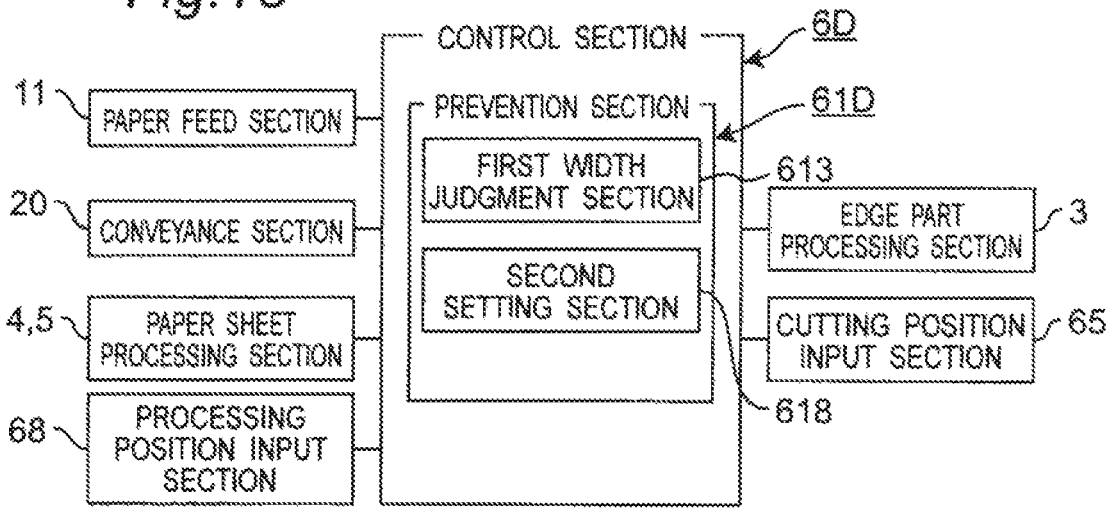
FIG. 13 is a block diagram showing a control section of a paper sheet processing apparatus according to a sixth embodiment of the present invention.

FIG. 13 is a block diagram showing a control section 6D of a paper sheet processing apparatus according to a sixth embodiment of the present invention. The present embodiment is different from the first embodiment in the following point alone.

(a) The prevention section 61D includes a first width judgment section 613 and a second setting section 618. The first width judgment section 613 is the same as that in the first embodiment. The second setting section 618 is constructed such as to, when the determination result of the first width judgment section 613 indicates that "the feed paper sheet width Wp is greater", set forcedly the cutting position of the edge part processing section 3 to be a position within the paper passable region.

The second setting section 618 is constructed such as to, regardless of whatever cutting position the cutting device 3A is located at, set forcedly the cutting position of the cutting device 3A to be a position within the paper passable region. Specifically, similarly to the first setting section 617, the second setting section 618 causes the width-directional moving mechanism of the cutting device 3A to operate so as to move the cutting device 3A in the width directions.

According to the present embodiment, when the determination result of the first width judgment section 613 indicates that "the feed paper sheet width Wp is greater", regardless of the cutting position of the edge part processing section 3 and regardless of whatever cutting position the cutting device 3A is located at, the second setting section 618 operates so as to set forcedly the cutting position of the cutting device 3A to be a position within the paper passable region. Thus, in a case that a paper sheet having a width greater than the paper passable region width Wb is set in the paper feed section 11, the paper sheet is cut by the cutting device 3A so that a paper sheet having a width smaller than or equal to the paper passable region width Wb is reliably obtained. Then, even when the paper sheet is conveyed to the paper sheet processing sections 4 and 5, the paper sheet does not interfere with the drive mechanism for the paper sheet processing sections 4 and 5 and hence a paper jam does not occur there. Thus, a paper jam is avoided in the paper sheet processing sections 4 and 5.

The other operation effects and modifications are the same as those in the fifth embodiment.

Seventh Embodiment

Figure 14:
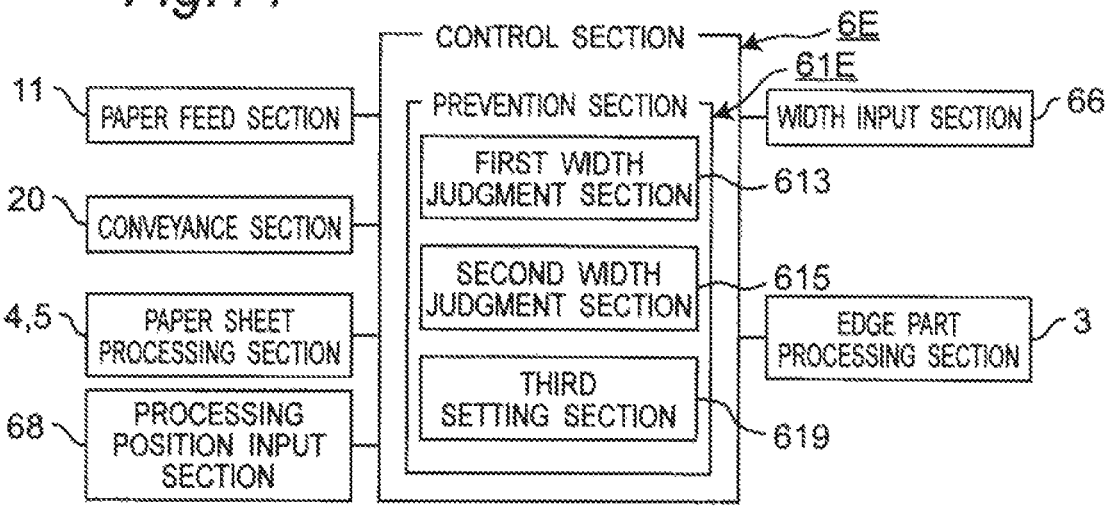
FIG. 14 is a block diagram showing a control section of a paper sheet processing apparatus according to a seventh embodiment of the present invention.

FIG. 14 is a block diagram showing a control section 6E of a paper sheet processing apparatus according to a seventh embodiment of the present invention. The present embodiment is different from the first embodiment in the following points alone.

(a) The cutting position input section 65 is not provided.

(b) A width input section 66 is provided. The width input section 66 is the same as that in the fourth embodiment.

(c) The prevention section 61E includes a first width judgment section 613, a second width judgment section 615, and a third setting section 619. The first width judgment section 613 and the second width judgment section 615 are the same as those in the fourth embodiment. The third setting section 619 is constructed such that when the determination result of the first width judgment section 613 indicates that "the feed paper sheet width Wp is greater" and the determination result of the second width judgment section 615 indicates that "the final paper sheet width Wz is greater", the third setting section 619 sets forcedly the cutting position of the edge part processing section 3 to be a position within the paper passable region.

According to the present embodiment, when the determination result of the first width judgment section 613 indicates that "the feed paper sheet width Wp is greater" and the determination result of the second width judgment section 615 indicates that "the final paper sheet width Wz is greater", the third setting section 619 operates so as to set forcedly the cutting position of the cutting device 3A to be a position within the paper passable region. Thus, in a case that a paper sheet having a width greater than the paper passable region width Wb is set in the paper feed section 11, the paper sheet is cut by the cutting device 3A so that a paper sheet having a width smaller than or equal to the paper passable region width Wb is reliably obtained. Then, even when the paper sheet is conveyed to the paper sheet processing sections 4 and 5, the paper sheet does not interfere with the drive mechanism for the paper sheet processing sections 4 and 5 and hence a paper jam does not occur there. Thus, a paper jam is avoided in the paper sheet processing sections 4 and 5.

The other operation effects and modifications are the same as those in the fifth embodiment.

Eighth Embodiment

The present embodiment is different from the first embodiment in the following point alone.

(a) The prevention section 61 is constructed from the edge part processing section 3 in which the cutting position in a standby state is set to be a position within the paper passable region. Here, the "cutting position in a standby state" indicates a position where the cutting device is to stand by when a specification that cutting is unnecessary is inputted through the cutting position input section 65 or when no input is performed through the cutting position input section 65.

According to the present embodiment, the cutting position of the edge part processing section 3 in a standby state is located at a position within the paper passable region. Thus, despite that the feed paper sheet width Wp is greater than the paper passable region width Wb, even when the operator has missed setting the cutting position of the edge part processing section 3 or, alternatively, has erroneously judged that cutting by the edge part processing section 3 is unnecessary, the paper sheet having been fed from the paper feed section 11 is cut by the edge part processing section 3 so that a paper sheet having a width smaller than or equal to the paper passable region width Wb is reliably obtained. Then, even when the paper sheet is conveyed to the paper sheet processing sections 4 and 5, the paper sheet does not interfere with the drive mechanism for the paper sheet processing sections 4 and 5 and hence a paper jam does not occur there. Thus, a paper jam is avoided in the paper sheet processing sections 4 and 5.

The other operation effects and modifications are the same as those in the fifth embodiment.

Ninth Embodiment

The present embodiment is different from the first embodiment in the following point alone.

(a) The prevention section 61 is constructed from the edge part processing section 3 controlled such that the width-directional moving mechanism can move the cutting device within the paper passable region alone.

According to the present embodiment, despite that the feed paper sheet width Wp is greater than the paper passable region width Wb, even when the operator has missed setting the cutting position of the edge part processing section 3, the cutting device of the edge part processing section 3 is located only within the paper passable region. Thus, the paper sheet having been fed from the paper feed section 11 is cut by the edge part processing section 3 so that a paper sheet having a width smaller than or equal to the paper passable region width Wb is reliably obtained. Then, even when the paper sheet is conveyed to the paper sheet processing sections 4 and 5, the paper sheet does not interfere with the drive mechanism for the paper sheet processing sections 4 and 5 and hence a paper jam does not occur there. Thus, a paper jam is avoided in the paper sheet processing sections 4 and 5.

The other operation effects and modifications are the same as those in the fifth embodiment.

Figure 15:
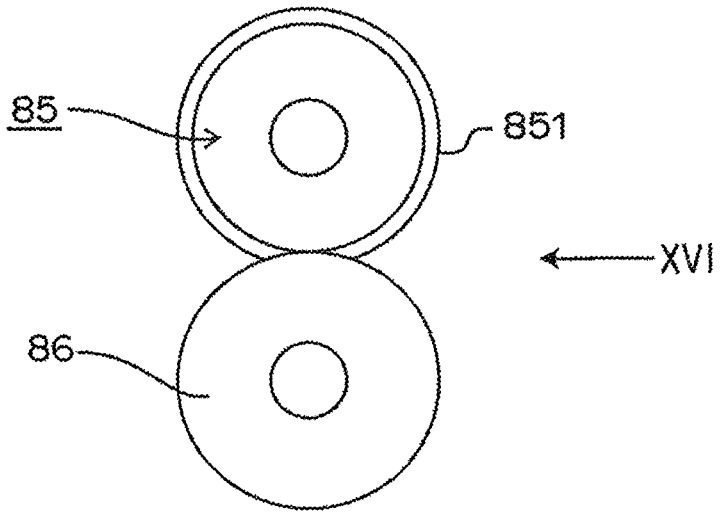
FIG. 15 is a diagram showing a blade of a fold mark processing section.
Figure 16:
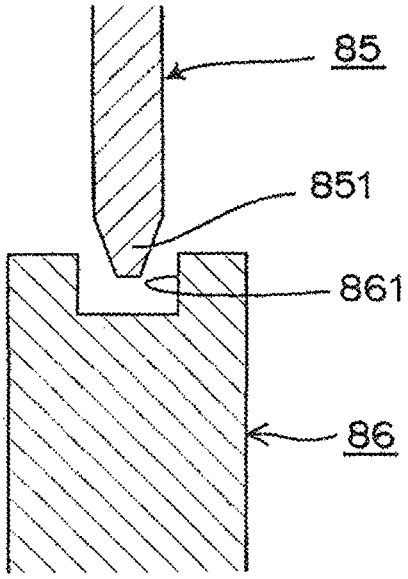
FIG. 16 is an expanded sectional view taken from an arrow-XVI direction in FIG. 15.

Other Embodiments (1) A fold mark processing section for forming a fold mark in the paper sheet along the conveyance direction Y at an arbitrary processing position in the width directions may be employed as the additional processing section 8. The fold mark processing section has a configuration that, as shown in FIG. 15 and in FIG. 16 showing a view taken from an arrow-XVI direction in FIG. 15, a rotary blade 85 and a fixed blade 86 are employed in place of the upper rotary blade 31 and the lower rotary blade 32 of the paper sheet processing section 4. Specifically, the fold mark processing section is constructed such that a protrusion 851 of a rotary blade 85 together with the paper sheet is inserted into a recess 861 of a fixed blade 86 and thereby the paper sheet is pressed so that a fold mark is formed in the paper sheet.

Figure 17:
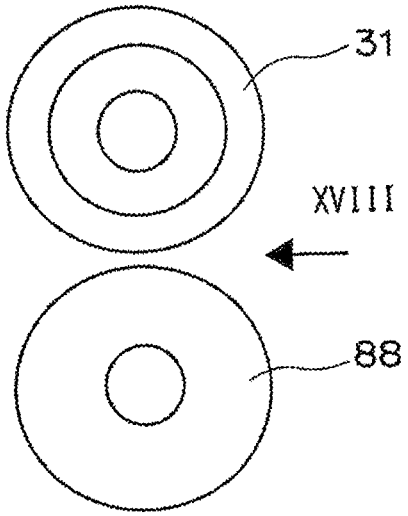
FIG. 17 is a diagram showing a blade of a half-cut processing section.
Figure 18:
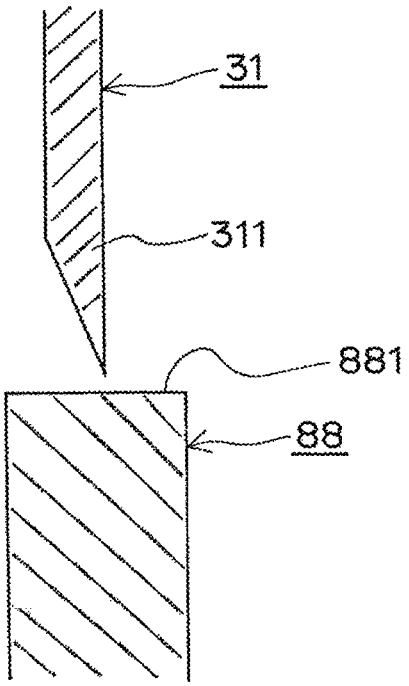
FIG. 18 is an expanded sectional view taken from an arrow-XVIII direction in FIG. 17.

(2) A half-cut processing section for forming a half cut in the paper sheet along the conveyance direction Y at an arbitrary processing position in the width directions may be employed as the additional processing section 8. The half-cut processing section has a configuration that, as shown in FIG. 17 and in FIG. 18 showing a view taken from an arrow-XVIII direction in FIG. 17, a fixed member 88 is employed in place of the lower rotary blade 32 of the paper sheet processing section 4. Specifically, the half-cut processing section is constructed such as to cause the blade edge 311 of the upper rotary blade 31 to enter the paper sheet until a predetermined gap is formed between the blade edge 311 and the surface 881 of the fixed member 88 so that a half cut is formed in the paper sheet.

(3) The conveyance-directional processing section, the transverse processing section, the perforation processing section, the fold mark processing section, and the half-cut processing section may be employed as any of the paper sheet processing sections 4 and 5 and the additional processing section 8.

Figure 19:
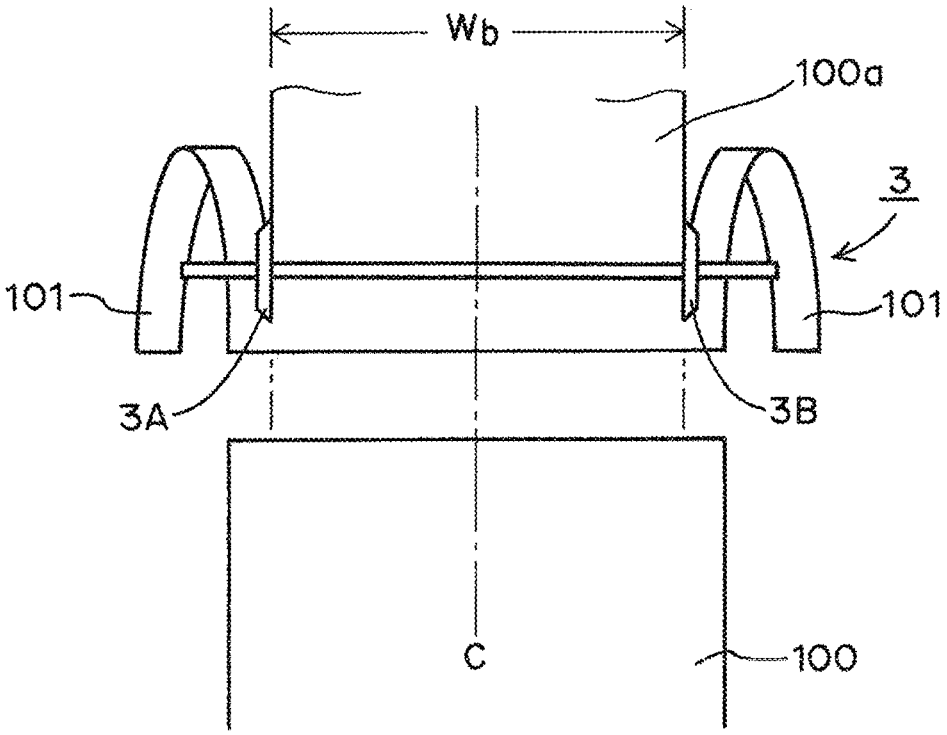
FIG. 19 is a schematic part plan view showing an operating state in a center reference mode.

(4) The conveyance section 20 may convey the paper sheet 100 in a center reference mode, that is, with adopting the center C as a reference as shown in FIG. 19. In this case, the processing positions of the cutting devices 3A and 3B on both sides are adjusted. Then, similarly to the fifth to the ninth embodiment, thus, in a case that the paper sheet 100 having a width greater than the paper passable region width Wb is set in the paper feed section 11, the paper sheet 100 is cut by the cutting devices 3A and 3B and thereby the edge parts 101 on both sides are separated from the paper sheet 100 so that a paper sheet 100*a* having a width smaller than or equal to the paper passable region width Wb is reliably obtained.

(5) The paper ejection section 12 may be provided in the inside of the apparatus main body 10. In this case, the paper ejection port 122 is not provided and the paper ejection tray 121 is provided in the inside of the apparatus main body 10. Thus, the paper sheet ejected into the paper ejection tray 121 is extracted in a manner that in an operation stopped state of the paper sheet processing apparatus 1, the operator opens the access cover in the upper part of the apparatus main body 10 and then puts the hand into the inside.

INDUSTRIAL APPLICABILITY

In the paper sheet processing apparatus of the present invention, even when a paper sheet having a width greater than the paper passable region width is set in the paper feed section, occurrence of a paper jam or breakage of the paper sheet processing section can be avoided. Thus, a high industrial utility value is obtained.

DESCRIPTION OF REFERENCE NUMERALS

1 Paper sheet processing apparatus
10 Apparatus main body
11 Paper feed section
12 Paper ejection section
122 Paper ejection port
100 Paper sheet
101 Edge part
20 Conveyance section
22 Conveyance path
3 Edge part processing section
4, 5 Paper sheet processing section
61 Prevention section
611 Position judgment section
612 First prevention warning section
613 First width judgment section
614 Second prevention warning section

615 Second width judgment section
616 Third prevention warning section
617 First setting section
618 Second setting section
619 Third setting section
65 Cutting position input section
66 Width input section
8 Additional processing section

The invention claimed is:

1. A paper sheet processing apparatus for processing a paper sheet, comprising:

an apparatus main body including:

a paper feed section for feeding the paper sheet;

a conveyance section for conveying the paper sheet, after the paper sheet has been fed by the paper feed section, along a conveyance path;

at least one paper sheet processing section for performing predetermined processing on the paper sheet, wherein a paper passable region width, defined as a dimension of a paper passable region of the conveyance path in a width direction perpendicular to a conveyance direction, is set to be a maximum width dimension that permits conveyance of the paper sheet without interference in the at least one paper sheet processing section, when the at least one paper sheet processing section is in a standby state; and a prevention section for, when a feed paper sheet width defined as a width dimension of a to-be-fed paper sheet is greater than the paper passable region width, preventing the to-be-fed paper sheet from being conveyed intact to the at least one paper sheet processing section;

wherein the apparatus main body includes:

an edge part processing section for cutting the paper sheet, after having been fed, along the conveyance direction and thereby cutting off one or both edge parts in the width direction from the paper sheet; and a cutting position input section through which an operator inputs a cutting position of the edge part processing section, wherein the prevention section includes:

a first width judgment section for judging whether the feed paper sheet width is greater than the paper passable region width;

a position judgment section for judging whether the cutting position of the edge part processing section is located outside the paper passable region in the width direction; and a first prevention warning section for, when a determination result of the first width judgment section indicates that "the feed paper sheet width is greater" and a determination result of the position judgment section indicates that "the position is located outside", preventing operation of the paper feed section or the conveyance section and/or issuing a warning.

2. The paper sheet processing apparatus according to claim 1, further comprising:

a paper ejection section for ejecting the paper sheet through a paper ejection port of the apparatus main body to an outside of the main body, wherein the paper passable region width is set to be no greater than a width of the paper ejection port.

3. The paper sheet processing apparatus according to claim 2, wherein the apparatus main body includes an additional processing section for performing predetermined additional processing on the paper sheet ejected through the paper ejection port of the apparatus main body, wherein the paper passable region width is set to be no greater than a second maximum width dimension that permits conveyance of the paper sheet without a paper jam in the additional processing section.

4. The paper sheet processing apparatus according to claim 1, further comprising a width input section through which the operator inputs a final paper sheet width indicating a width dimension of the paper sheet to be obtained after final processing, wherein the prevention section includes:

a second width judgment section for judging whether the final paper sheet width is greater than the paper passable region width; and a third prevention warning section for, when the determination result of the first width judgment section indicates that "the feed paper sheet width is greater" and a determination result of the second width judgment section indicates that "the final paper sheet width is greater", preventing operation of the paper feed section or the conveyance section and/or issuing the warning.

5. The paper sheet processing apparatus according to claim 1, wherein the prevention section includes:

a first setting section for, when the determination result of the first width judgment section indicates that "the feed paper sheet width is greater" and the determination result of the position judgment section indicates that "the position is located outside", setting forcedly the cutting position of the edge part processing section to be a position within the paper passable region.

6. The paper sheet processing apparatus according to claim 1, wherein the prevention section includes:

a second setting section for, when the determination result of the first width judgment section indicates that "the feed paper sheet width is greater", setting forcedly the cutting position of the edge part processing section to be a position within the paper passable region.

7. The paper sheet processing apparatus according to claim 1, further comprising:

a width input section through which the operator inputs a final paper sheet width indicating a width dimension of the paper sheet to be obtained after final processing, wherein the prevention section includes:

a second width judgment section for judging whether the final paper sheet width is greater than the paper passable region width; and a third setting section for, when the determination result of the first width judgment section indicates that "the feed paper sheet width is greater" and a determination result of the second width judgment section indicates that "the final paper sheet width is greater", setting forcedly the cutting position of the edge part processing section to be a position within the paper passable region.

* * * * *